US011027186B2

(12) United States Patent
Garland et al.

(10) Patent No.: US 11,027,186 B2
(45) Date of Patent: Jun. 8, 2021

(54) PROTECTIVE HEADGEAR FOR SPORTS PARTICIPANTS, ESPECIALLY BASEBALL FIELDERS

(71) Applicant: Major League Baseball Properties, Inc., New York, NY (US)

(72) Inventors: Tylor Garland, Los Angeles, CA (US); Stephen Bradford, Los Angeles, CA (US); Robert Reich, Los Angeles, CA (US)

(73) Assignee: MAJOR LEAGUE BASEBALL PROPERTIES, INC., New York, NY (US)

( * ) Notice: Subject to any disclaimer, the term of this patent is extended or adjusted under 35 U.S.C. 154(b) by 442 days.

(21) Appl. No.: 15/073,134

(22) Filed: Mar. 17, 2016

(65) Prior Publication Data

US 2016/0271482 A1 Sep. 22, 2016

Related U.S. Application Data

(60) Provisional application No. 62/134,337, filed on Mar. 17, 2015, provisional application No. 62/294,444, filed on Feb. 12, 2016.

(51) Int. Cl.
*A63B 71/10* (2006.01)
*A42B 3/06* (2006.01)
(Continued)

(52) U.S. Cl.
CPC ..... *A63B 71/10* (2013.01); *A42B 3/06* (2013.01); *A42B 3/063* (2013.01); *A42B 3/124* (2013.01);
(Continued)

(58) Field of Classification Search
CPC ..... A63B 71/10; A63B 2102/18; A63B 2102/182; A42B 3/06; A42B 3/128;
(Continued)

(56) References Cited

U.S. PATENT DOCUMENTS 1,501,507 A 7/1924 Wetherbee
2,143,483 A 1/1939 Samuel
(Continued)

FOREIGN PATENT DOCUMENTS

CA 2926979 A1 * 4/2015 ..... A42B 3/12
CN 1268084 9/2000
(Continued)

OTHER PUBLICATIONS

Markwort C-Flap Batter Protection (Free Shipping). Datasheet [online]. www.ithacasports.com, 2014 [retrieved on Feb. 9, 2016]. Retrieved from the Internet: <URL: http://web.archive.org/web/20141220212214/http://www.ithacasports.com/markwort-cflap.html>.
(Continued)

*Primary Examiner* — Jocelyn Bravo
(74) *Attorney, Agent, or Firm* — Leason Ellis LLP

(57) ABSTRACT

A protective headgear for a baseball or softball fielder includes a rigid outer protective shell that has a first side portion, an opposing second side portion and a brim that extends outwardly from a front portion. The outer protective shell has a top opening and a rear opening that is defined between the first and second side portions. As a result, the protective headgear does not completely circumscribe the fielder's head. The protective headgear also includes an impact absorption material disposed along an inner surface of the outer protective shell and also an inner cap to be worn beneath the outer protective shell. The inner cap is formed of a breathable material and can be in the form of a skull cap.

20 Claims, 12 Drawing Sheets

(51) Int. Cl.

| | |
|---|---|
| ***A42B 3/12*** | (2006.01) |
| ***A42B 3/22*** | (2006.01) |
| ***A42B 3/16*** | (2006.01) |
| ***A63B 102/18*** | (2015.01) |

(52) U.S. Cl.

CPC ..... *A42B 3/125* (2013.01); *A42B 3/128* (2013.01); *A42B 3/16* (2013.01); *A42B 3/227* (2013.01); *A63B 2102/18* (2015.10); *A63B 2102/182* (2015.10)

(58) Field of Classification Search

CPC ..... A42B 3/10; A42B 3/324; A42B 3/227; A42B 3/16; A42B 3/125; A42B 3/063; A42B 3/22; A42B 1/064

USPC ..... 2/412, 417, 418

See application file for complete search history.

(56) References Cited

U.S. PATENT DOCUMENTS 2,218,947 A 10/1940 Brunzell
2,798,222 A * 7/1957 Evans ..... A42B 3/225 2/9
2,861,270 A 11/1958 Mccoy
3,133,289 A 5/1964 Lipschutz
3,329,968 A * 7/1967 Gordon ..... A42B 3/12 2/418
3,447,163 A * 6/1969 Tojeiro ..... A42B 3/124 2/412
4,012,794 A 3/1977 Nomiyama
4,404,690 A 9/1983 Farquharson
4,432,100 A * 2/1984 Bates ..... A42B 3/225 2/424
4,472,472 A 9/1984 Schultz
4,736,469 A * 4/1988 Boretti ..... A42B 3/00 2/411
4,768,231 A 9/1988 Schrack
4,809,690 A 3/1989 Bouyssi et al.
4,982,451 A 1/1991 Graham
4,986,282 A * 1/1991 Stackhouse ..... A61F 9/02 128/857
5,035,009 A 7/1991 Wingo, Jr. et al.
5,226,180 A 7/1993 Leach
5,437,064 A 8/1995 Hamaguchi
5,477,563 A 12/1995 Gentes et al.
5,657,492 A 8/1997 Esposito, Jr.
5,765,223 A * 6/1998 McCausland ..... A61F 9/02 2/426
5,815,847 A 10/1998 Holden, Jr.
5,829,065 A 11/1998 Cahill
5,918,309 A * 7/1999 Bachner, Jr. ..... F41H 5/0457 2/2.5
6,070,271 A * 6/2000 Williams ..... A42B 3/066 2/412
6,131,207 A 10/2000 Basson et al.
6,154,889 A 12/2000 Moore, III et al.
6,292,952 B1 9/2001 Watters et al.
6,539,556 B1 4/2003 Barker
6,565,461 B1 5/2003 Zatlin
6,567,993 B2 5/2003 Robertson
6,625,820 B1 9/2003 Lampe
7,043,761 B2 5/2006 Epling
7,096,512 B2 8/2006 Blair
7,150,217 B2 * 12/2006 Kershaw ..... A41D 13/05 89/36.05
7,254,843 B2 * 8/2007 Talluri ..... A42B 3/063 2/411
7,464,414 B2 12/2008 Mcduff
7,565,704 B2 7/2009 Wu
7,673,350 B2 3/2010 Mazzoccoli et al.
7,774,866 B2 8/2010 Ferrara
7,937,778 B1 5/2011 Norton
7,966,673 B1 6/2011 Gibson
8,001,622 B1 8/2011 Culley et al.
8,056,150 B2 11/2011 Stokes et al.
8,087,101 B2 1/2012 Ferguson
8,214,928 B1 7/2012 Cleveland et al.
8,458,820 B2 6/2013 Cleva
8,528,119 B2 9/2013 Ferrara
8,566,968 B2 10/2013 Marzec et al.
8,631,518 B1 1/2014 Jennings
8,739,316 B1 6/2014 Norton
8,776,273 B2 7/2014 Krause
9,009,871 B2 4/2015 Shasha et al.
2001/0023504 A1 9/2001 Yoon
2002/0184699 A1 * 12/2002 Ewing ..... A42B 3/128 2/412
2004/0025231 A1 2/2004 Ide et al.
2004/0034903 A1 2/2004 Blair
2004/0154080 A1 8/2004 Abelman et al.
2004/0181854 A1 9/2004 Primrose
2005/0086727 A1 4/2005 Shen
2006/0059606 A1 * 3/2006 Ferrara ..... A01N 25/18 2/412
2006/0064801 A1 3/2006 Johnson et al.
2006/0143807 A1 * 7/2006 Udelhofen ..... A63B 71/10 2/425
2006/0168712 A1 8/2006 Mazzoccoli et al.
2007/0130673 A1 6/2007 Wasserkrug et al.
2007/0157370 A1 * 7/2007 Joubert Des Ouches ..... A42B 3/32 2/410
2007/0250990 A1 11/2007 Brown et al.
2008/0120764 A1 * 5/2008 Sajic ..... A42B 3/063 2/411
2009/0260133 A1 * 10/2009 Del Rosario ..... A42B 3/062 2/412
2010/0095438 A1 * 4/2010 Moelker ..... A42B 3/145 2/418
2010/0132094 A1 6/2010 Mullen
2011/0047680 A1 * 3/2011 Hoying ..... A42B 3/069 2/414
2011/0271430 A1 11/2011 Lowe et al.
2011/0307997 A1 12/2011 Blair
2012/0131731 A1 5/2012 Motroni
2012/0198604 A1 8/2012 Weber et al.
2012/0233745 A1 9/2012 Veazie
2012/0260405 A1 10/2012 Shen
2012/0260406 A1 10/2012 Green et al.
2012/0266365 A1 10/2012 Cohen
2013/0042395 A1 2/2013 Litterini
2013/0061375 A1 3/2013 Bologna et al.
2013/0174329 A1 7/2013 Hanson et al.
2013/0219593 A1 8/2013 Snyder
2013/0247283 A1 9/2013 Krause
2013/0298316 A1 11/2013 Jacob et al.
2013/0312161 A1 11/2013 Anderson et al.
2013/0318690 A1 12/2013 Cleva
2013/0318691 A1 * 12/2013 Krick ..... A42B 3/221 2/425
2014/0068840 A1 3/2014 Nauman et al.
2014/0075652 A1 3/2014 Hanson et al.
2014/0123372 A1 5/2014 Shen
2014/0157494 A1 * 6/2014 Olivares Velasco ... A42B 3/125 2/411
2014/0237706 A1 8/2014 O'conner
2015/0000015 A1 * 1/2015 Beauchamp ..... A42B 3/324 2/418
2016/0249702 A1 * 9/2016 Pfanner ..... A42B 3/125 2/416

FOREIGN PATENT DOCUMENTS

CN 2699959 5/2005
CN 101827537 9/2010
CN 103153106 6/2013
CN 203575709 5/2014
EP 0280042 8/1988
JP 1976-078446 7/1976
JP H 5-96025 U 12/1993
JP 1996-260218 10/1996

(56) References Cited

FOREIGN PATENT DOCUMENTS

| | | |
|---|---|---|
| JP | 1988-240891 | 10/1998 |
| JP | 2002-058773 | 2/2002 |
| JP | 3111327 | 7/2005 |
| JP | 2008-529747 | 8/2008 |
| JP | 2013-034747 | 2/2013 |
| JP | 3189125 | 2/2014 |
| WO | WO 2006/005143 | 1/2006 |

OTHER PUBLICATIONS

Kevlar. Datasheet [online]. Wikipedia, 2016 [retrieved on Feb. 9, 2016]. Retrieved from the Internet: <URL: https://en.wikipedia.org/wiki/Kevlar>.

Optical Amagan in HYOGO, "Craft center of Flip-up type sunglasses and flip-up type powered sunglasses", Feb. 4, 2016, Searched: Mar. 19, 2020, URL: https://web.archive.org/web/20160204234859/https://amagan.jp/senka29.html (disclosure of well-known arts).

* cited by examiner

PROTECTIVE HEADGEAR FOR SPORTS PARTICIPANTS, ESPECIALLY BASEBALL FIELDERS

CROSS-REFERENCE TO RELATED PATENT APPLICATIONS

This application is based on and claims priority to U.S. Provisional Patent Application 62/134,337, filed Mar. 17, 2015, and U.S. Provisional Patent Application 62/294,444, filed Feb. 12, 2016, the entire contents of each is incorporated by reference herein as if expressly set forth in its respective entirety herein.

TECHNICAL FIELD

The present invention relates to sports equipment and more particularly, relates to protective headgear that is designed to be worn by a baseball or softball fielder, especially a pitcher, to protect the fielder's head and face from being struck by a batted ball.

BACKGROUND

Baseball is known as America's pastime. Baseball is a bat-and-ball game played between two teams of nine players each who take turns batting and fielding. The offense attempts to score runs by hitting a ball thrown by the pitcher with a bat and moving counter-clockwise around a series of four bases, namely, first, second, third and home plate. A run is scored when a player advances around the bases and returns to home plate.

Fielders wear gloves to assist in catching a hit ball and typically wear soft brim caps as part of their uniforms. Batted balls can reach high speeds and therefore, there is a desire to provide the fielders with head and face protection from such batted balls.

SUMMARY

In one embodiment of the present invention, a protective headgear for a baseball or softball fielder (e.g., a pitcher thereof) is provided and includes a rigid outer protective shell that has a front portion, a first side portion, an opposing second side portion and a brim that extends outwardly from the front portion. The outer protective shell has a top opening and a rear opening that is defined between a first free end of the first side portion and a second free end of the second side portion. As a result, the protective headgear does not completely circumscribe the fielder's head. As described herein, the top opening allows the head to more easily "breathe" (allowing air and moisture transfer) and the rear opening allows the size (circumference) of the outer protective shell to be altered so as to ensure a proper snug fit is achieved regardless of the size of the fielder's head.

The protective headgear also includes an impact absorption material disposed along an inner surface of the outer protective shell and also an inner cap to be worn beneath the outer protective shell. In at least some of the embodiment, the headgear includes an impact absorption region that is formed as a multilayer structure formed of two or more energy absorbing materials. The inner cap is formed of a breathable material and can be in the form of a skull cap.

BRIEF DESCRIPTION OF THE DRAWING FIGURES

DETAILED DESCRIPTION OF CERTAIN EMBODIMENTS

Figure 1:
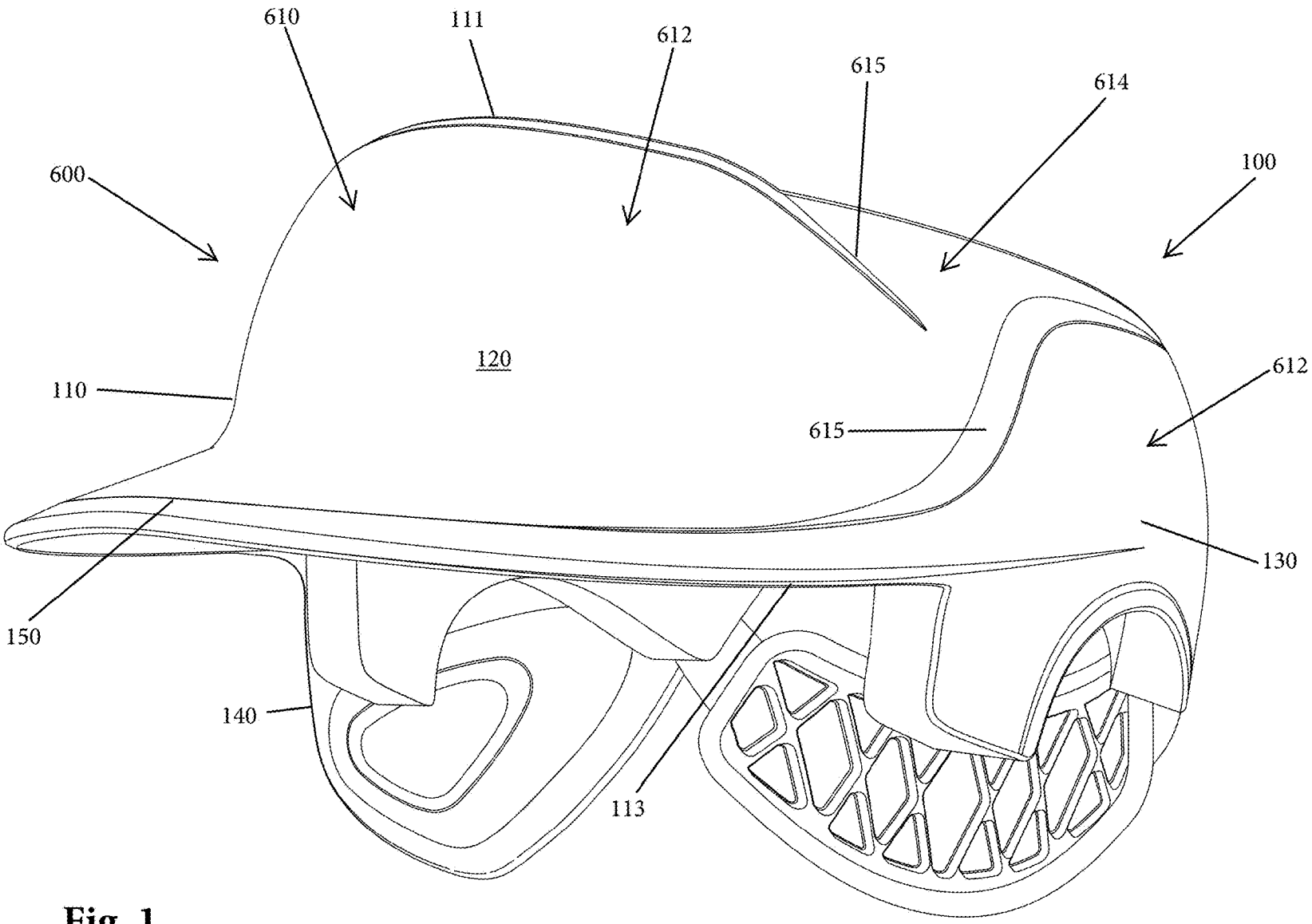
FIG. 1 is a front and side perspective view of a protective headgear in accordance with another embodiment of the present invention.
Figure 2:
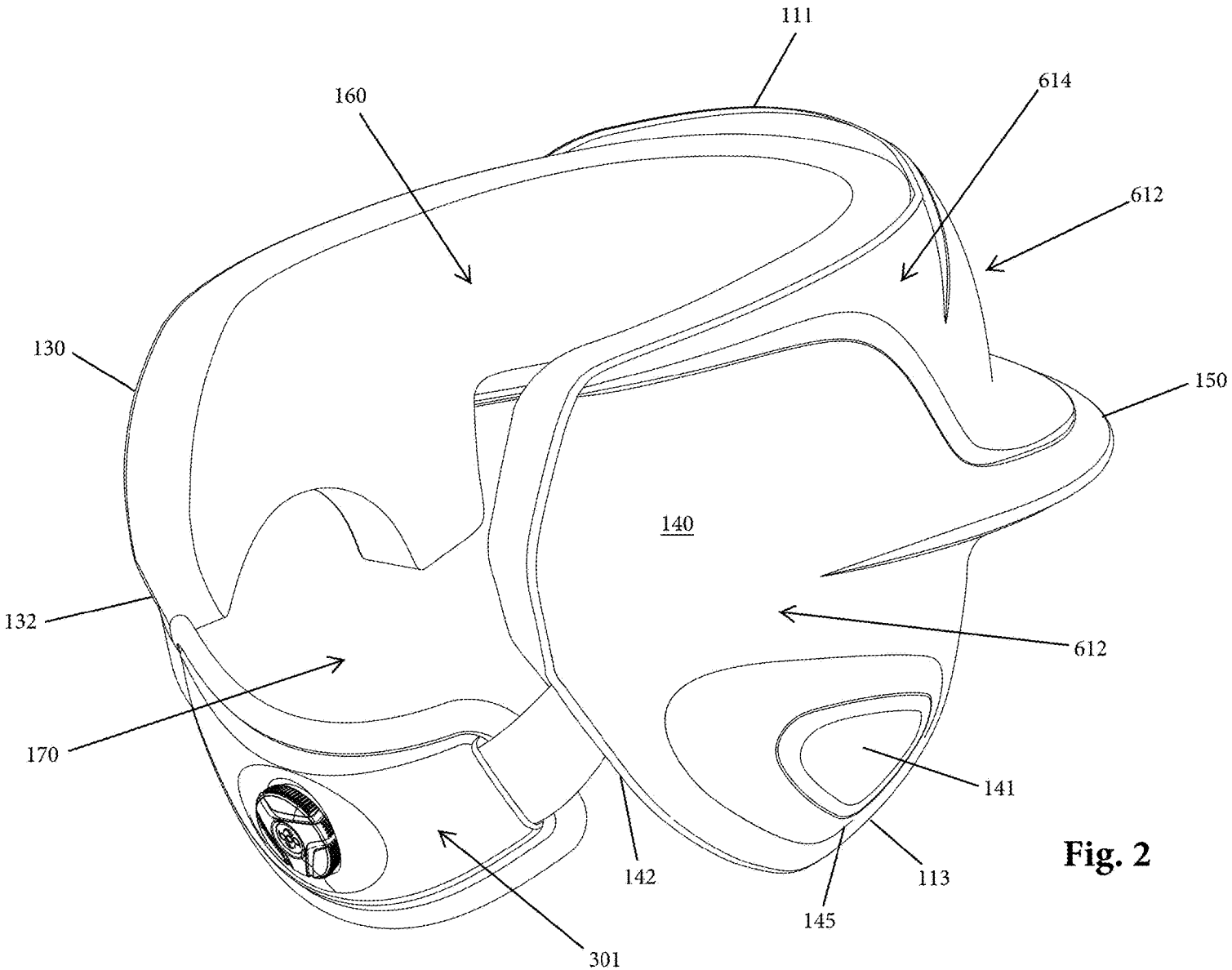
FIG. 2 is a rear and side perspective view of the protective headgear of FIG. 1.
Figure 3:
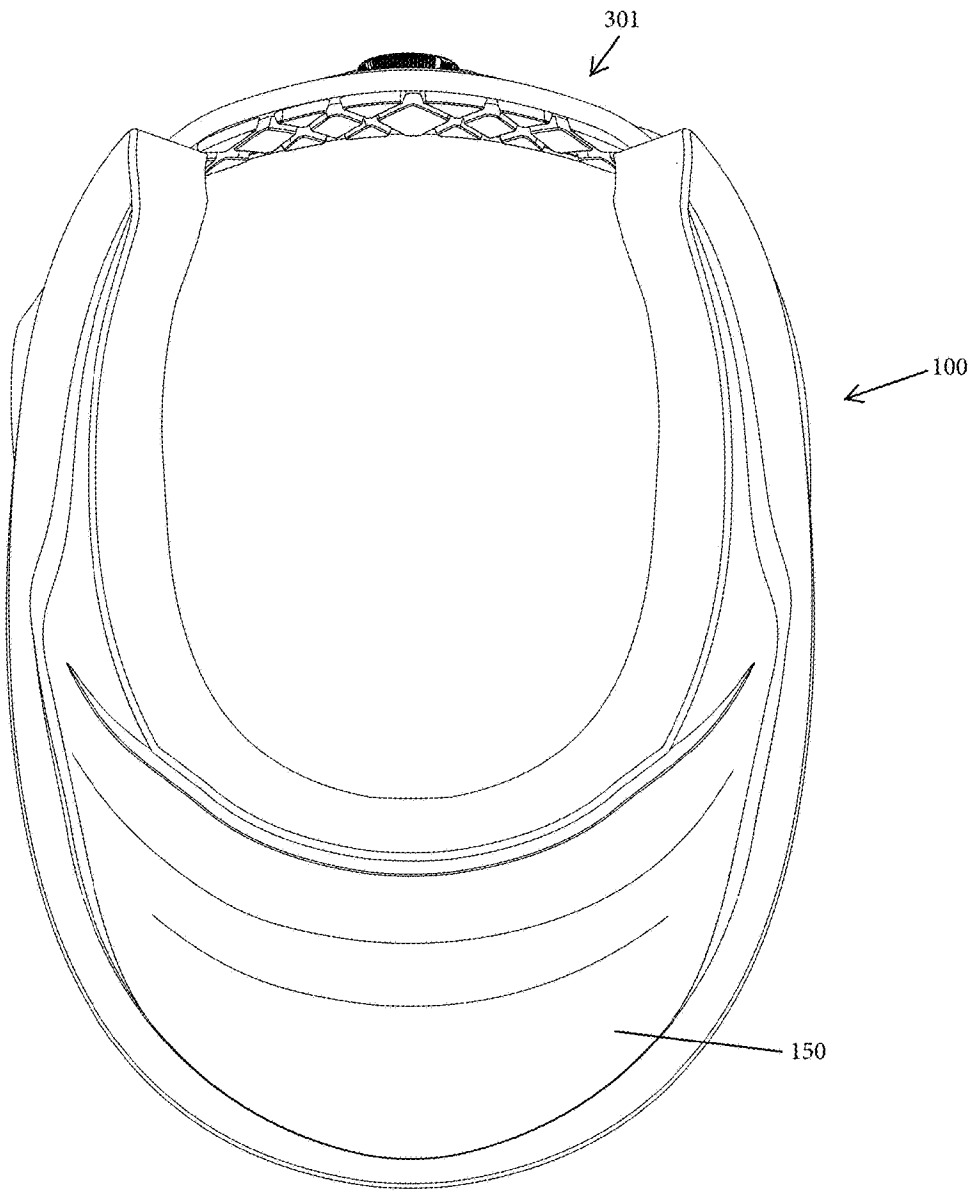
FIG. 3 is a top plan view of the protective headgear of FIG. 1.

FIGS. 1-13 illustrate protective headgear 100 for use by a sports participant and more specifically, the protective headgear 100 is particularly constructed for use by a player of a sport, and more particularly, a baseball fielder, such as a baseball pitcher. The protective headgear 100 can also be thought of as being a protective helmet or cap. As described herein, the protective headgear 100 includes features to protect a player's head and face from being struck by a batted ball.

The protective headgear 100 includes a number of different parts that are assembled to form the complete product and more specifically, the protective headgear 100 includes an outer protective shell 110. The outer protective shell 110 does not completely enclose the user's (player's) head but instead is designed such that it has an open top and an open rear. More specifically, the outer protective shell 110 has a front portion 120, a first side portion 130, an opposing second side portion 140 and a brim 150 that extends outwardly from the front portion 120. The outer protective shell 110 has a top opening 160 and a rear opening 170 that is defined between a free end 132 of the first side portion 130 and a free end 142 of the second side portion 140.

From a top view, the outer protective shell 110 generally has a U-shape in that it has an open rear as discussed above (i.e., the legs of the U are not continuous with one another). This U-shape allows for flex to accommodate varies head sizes and thus, serves as mechanism to ensure a proper fit with the user (fielder). The outer protective shell 110 has a top edge 111 that defines the top opening 160 and extends from the free end 132 of the first side portion 130 across the front portion 120 to the free end 142 of the second side portion 140. The top edge 111 is also U-shaped. A bottom edge 113 of the outer protective shell 110 is defined by and extends across the first side portion 130, the brim 150, and the second side portion 140.

Figure 5:
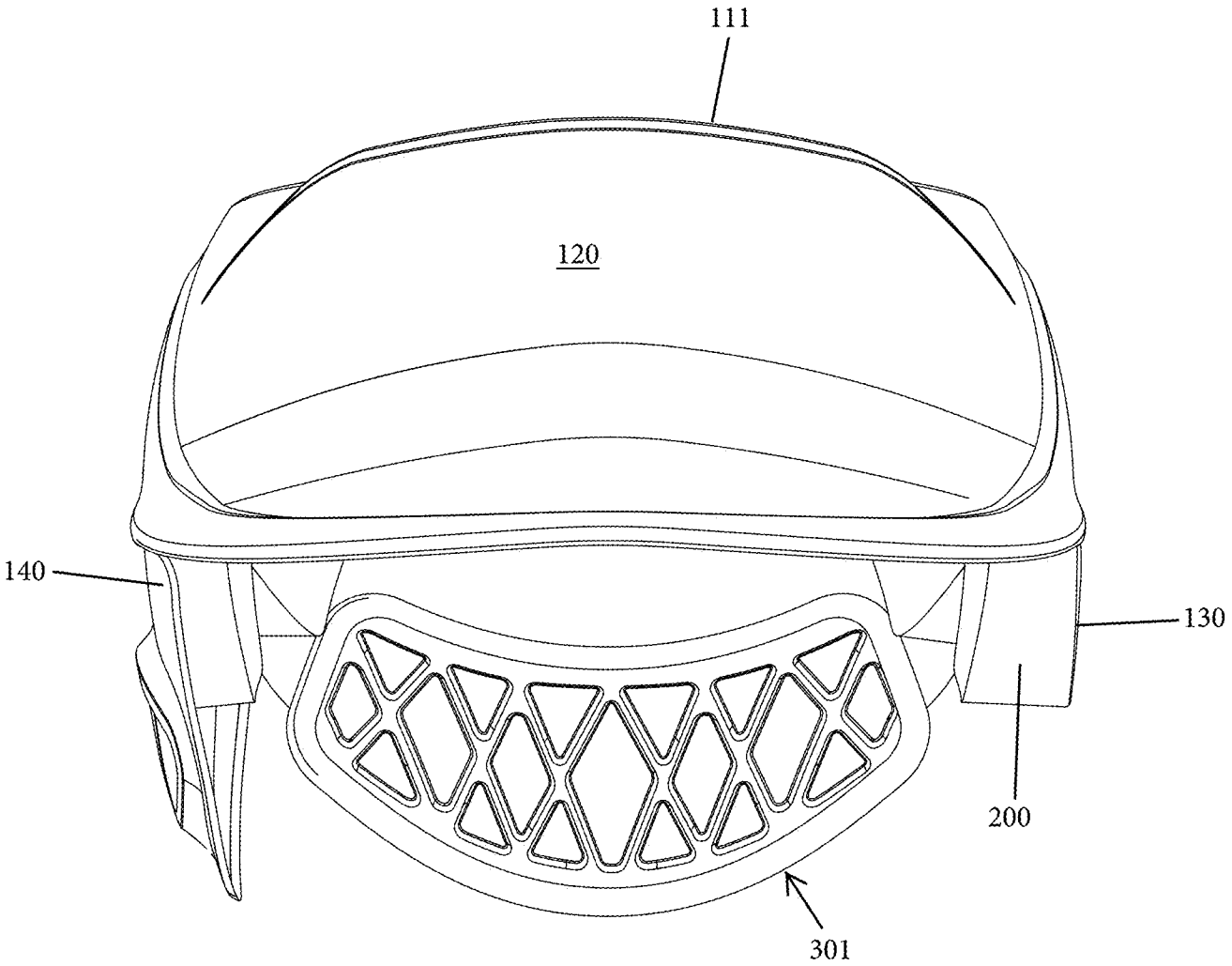
FIG. 5 is a front elevation view of the protective headgear of FIG. 1.

As shown in the views of FIGS. 1 and 5, the top edge 111 in the front portion 120 can be slightly elevated relative to the top edge 111 of the first and second side portions 130, 140.

The first side portion 130 can be thought of as being the left side earflap and the second side portion 140 can be thought of as being the right side earflap. When the protective headgear 100 is intended for use by a baseball pitcher, one of the first and second side portions 130, 140 can offer additional protection in view of the normal mechanics and motion of pitcher as the ball is released as shown and described herein.

It will also be appreciated that the first and second portions 130, 140 can, in one embodiment, be both modular and configurable so as to allow the first and second portions 130, 140 to be selected in view of certain parameters, such as the physical characteristics of the user (fielder). In this embodiment, the portions 130, 140 can thus be detachably coupled to the main (base) portion of the headgear. For example, a mechanical fit, such as a releasable snap-fit, can be provided between the portions 130, 140 and the main (base) portion to allow the user to select one portion 130 from amongst a set of portions 130 and one portion 140 from amongst a second of portion 140. In addition, other parts, including a rear tensioning mechanism for tightening the headgear can also be constructed so as to be modular in nature. Various types of exemplary rear tensioning mechanism are described herein.

Generally, the pitcher winds up and delivery begins when the pitcher brings his arms together in front of his body (this is called coming set). After coming set, the pitcher takes a step toward home and delivers the pitch. Typically, pitchers from the set use a high leg kick, thus lunging toward home in pitching; a pitcher may instead release the ball more quickly by using the slide step, quickly stepping directly and immediately toward home and pitching. After releasing the ball, the pitcher assumes a fielding position. The natural body movement of the pitcher exposes one side of the head more than the other side based on whether the pitcher is a left-handed pitcher or a right-handed pitcher. More specifically, if the pitcher is a right-handed pitcher, the right side of the head is more exposed to a ball strike and similarly, if the pitcher is a left-handed pitcher, the left side of the head is more exposed.

As described below, FIGS. 1-13 illustrate a protective headgear that has enhanced protection in that the temple protection can be asymmetric in that the temple protection (temple guard) on the dominant side of the player is enhanced, thereby resulting in different temple protection constructions. In another embodiment (not shown), the left side portion 130 and the right side portion 140 can be mirror images of one another in that the protective headgear in this embodiment offers symmetric temple protection (temple guards) and coverage over both ears.

More specifically, for purpose of illustration only, FIGS. 1-8, 11 and 12 show the protective headgear 100 for a right-handed pitcher having enhanced temple protection on the right side (pitching side in this example); however, it will be appreciated that in the protective headgear 100 for a left-handed pitcher, the additional protection is merely reversed and is part of the left-side portion 130.

Figure 6:
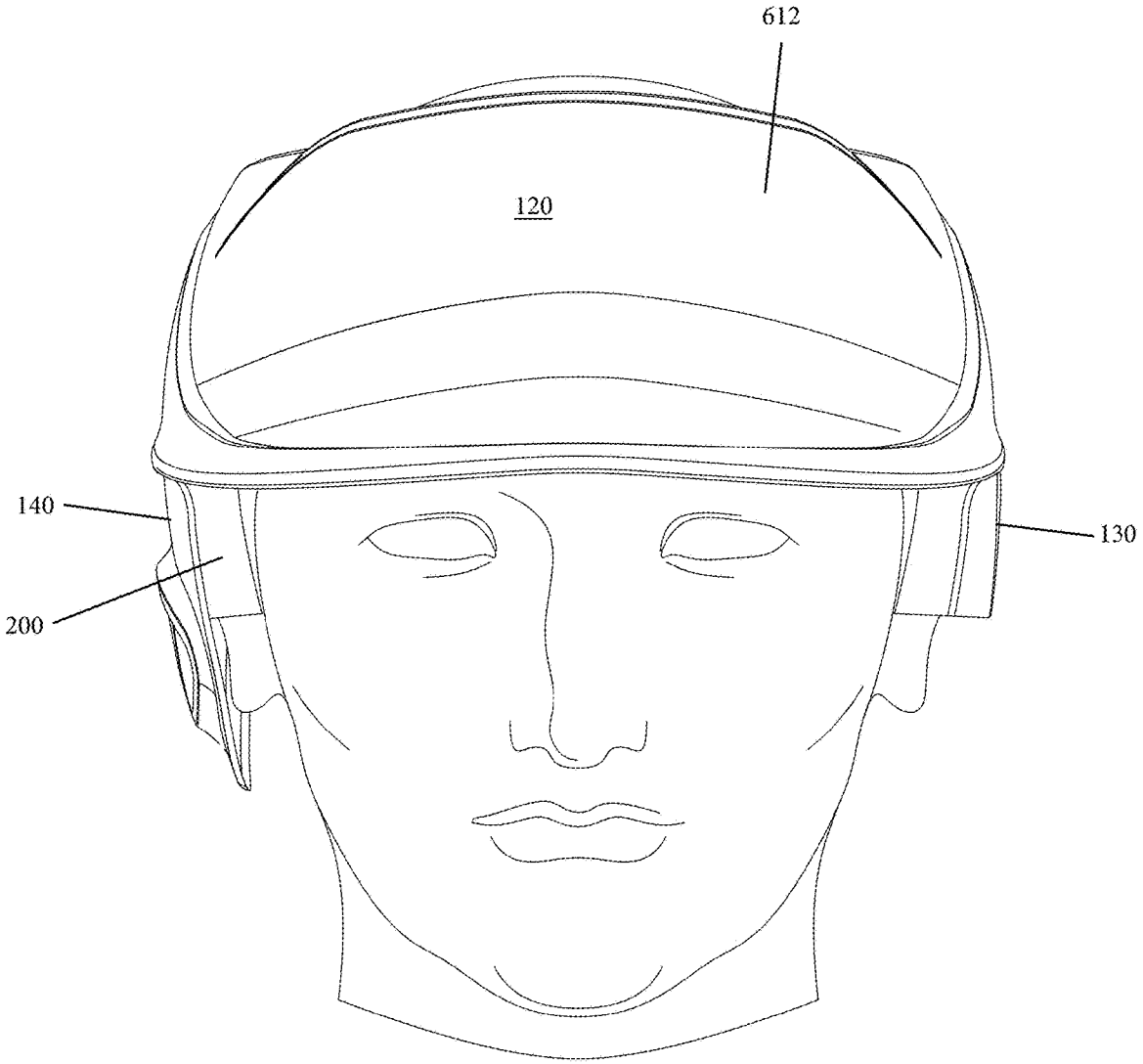
FIG. 6 is a front elevation view of the protective headgear of FIG. 1 in use.

For a right-handed pitcher, the left side (first side) portion 130 does not cover the left ear of the player but instead, the ear is left exposed as shown in FIG. 6. The left side portion 130 does include a first section 134 that provides temple protection and seats over the side of the head immediately in front of the left ear. The bottom edge of the left side portion 130 has a pronounced curved section 136 that accommodates the left ear and is disposed above the left ear during wearing of the protective headgear 100. The curved section 136 tapers downward behind the left ear to the free end 132 of the left side portion 130.

As mentioned, for a right-handed pitcher, the right side (second side) portion 140 includes enhanced protection in that the right side portion 140 hangs lower and substantially covers the right ear as shown in FIG. 6. An ear vent (opening) 141 is formed in the right side portion 140 to allow air to pass to the ear. As with the left side portion 130, the right side portion 140 has a first section 144 that covers the temple and seats over the head immediately in front of the right ear. The right side portion 140 extends over and covers the area of the head immediately behind the ear. The right side portion 140 can include a second section 145 that is located below the ear vent 141.

As shown in the figures, the right side portion 140 can be configured such that it also extends across an upper portion of the jaw. The illustrated ear vent 141 has a generally triangular or elongated shape and extends forward towards the face. However, it will be understood that the ear vent 141 can have any number of other shapes and can come in different sizes too.

The left side portion 130 can be thought of as being a left wing that extends rearwardly and the right side portion 140 can be thought of as being a right wing that extends rearwardly and is disposed across from the left side portion 130. The left and right wings 130, 140 are flexible in nature to allow the protective shell 110 to be fitted to different sized heads and allow the closing and opening of the protective headgear 100 as described herein. In other words, the flexible nature of the two wings 130, 140 allows these two structures to be drawn toward one another to tighten the headgear 100 or they can further be separated apart to loosen the headgear 100.

As shown in the figures, the top edge of the outer protective shell lies in at least two different planes with the top edge of the curved front portion 120 lying in a first plane above a second plane that contains at least a first portion of the first top edge of the first side wing 130 and at least a second portion of the second top edge of the second side wing 140. The second plane intersects the first plane and passes through the curved front portion and wherein each of the first top edge of the first side wing 130, including the first portion thereof, and the second top edge of the second side wing 140, including the second portion thereof, extends in a direction from the respective rear edge towards the brim 150 which lies in a third plane that intersects the rear edges of the first and second side wings. At least the first side wing 130 has an ear portion formed along a bottom edge thereof for covering an ear of the player. The first top edge extending above the ear portion and further extending forward of the ear portion towards the brim 150 and rearward of the ear portion towards the rear edge. The brim 150 is disposed between the first top edge and the bottom edge of the first side wing 130.

The outer protective shell 110 can be formed as a single piece (part) (integral structure) using traditional manufacturing techniques, such as a molding process. The outer protective shell 110 can be formed of any number of rigid materials that are suitable for the present application. In one exemplary embodiment, the outer protective shell 110 is formed of a composite material and more particularly, is formed of a carbon fiber/aramid composite for the purposed of dispensing impact energy across a field larger than the initial impact location. For example, the outer protective shell 110 can be made of a carbon fiber/aramid composite that has a thickness between about 1 mm and about 5 mm.

In one exemplary embodiment, the outer protective shell is formed of three layers of carbon fibers. For example, three layers of carbon weave cloth is combined with (embedded in) an epoxy resin to create the shell. The three layers can be laid out into an aluminum mold, are sandwiched against each other with an interior removable silicon "plug", and then baked together so that the epoxy resin flows through the three layers of carbon fiber fabric. Once it cools, the epoxy resin becomes hard and the three layers of carbon fiber fabric act as shock barriers dispersing impact energy.

As described herein, the outer protective shell 110 can have a variable thickness (e.g., between 1.0 mm and 1.5 mm). Two impact zones are formed to have a thickness of 1.5 mm and the rest of the shell is formed to have a thickness of 1.0 mm. The two impact zones that are 1.5 mm thick are defined as the "front" and "side" impact zones as described herein and as defined in the NOSCAE test protocol. The increased localized thickness allows the headgear 100 to pass testing in these two impact zones and the rest of the shell 110 is thinner (1.0 mm) to keep weight to a minimum.

It will be appreciated that other materials can be used to form the outer protective shell 110 and in particular, the shell 110 can be formed as a non-composite structure. In some applications, the shell 110 can be formed of polycarbonate or other suitable material. The shell 110 can also be constructed such that it includes a bonded interlayer of a honeycomb or copolymer extruded material. In addition, the shell 110 can be constructed such that includes an insert molded EPS foam substructure chemically bonded (or otherwise bonded) to the outer shell 110.

The protective headgear 100 includes an impact absorption structure (material) 200 that is disposed along and is secured to an inner surface of the outer protective shell 110. The impact absorption structure (material) 200 can be formed as a single layer from a single material or can be formed of two or more layers that are formed of different materials as shown in the exemplary figures. The impact absorption structure 200 is intended to provide primary impact absorption. Each of the structures (materials) that form the headgear provide a level of impact absorption; however, the primary area of the impact absorption is the structure 200. The bond between the shell 110 and the structure 200 (e.g., a honeycomb shaped structure as described herein) can be of a high strength to help engage the material of the structure 200 upon impact (e.g., help engage the cell structure of the honeycomb material upon impact).

Figure 14B:
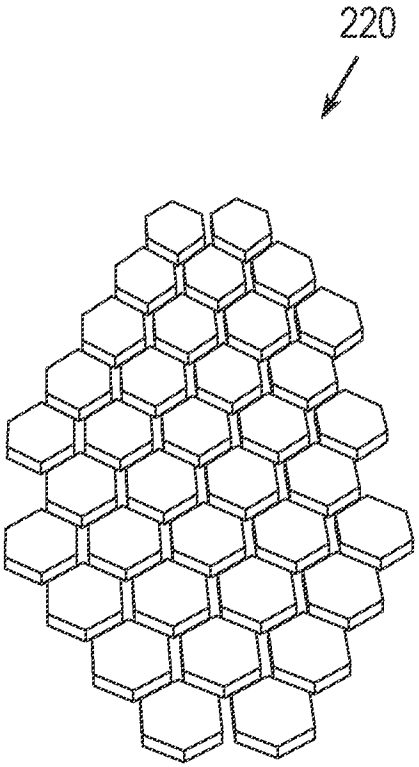
FIG. 14B illustrates an impact absorption layer according to a second embodiment.
Figure 14A:
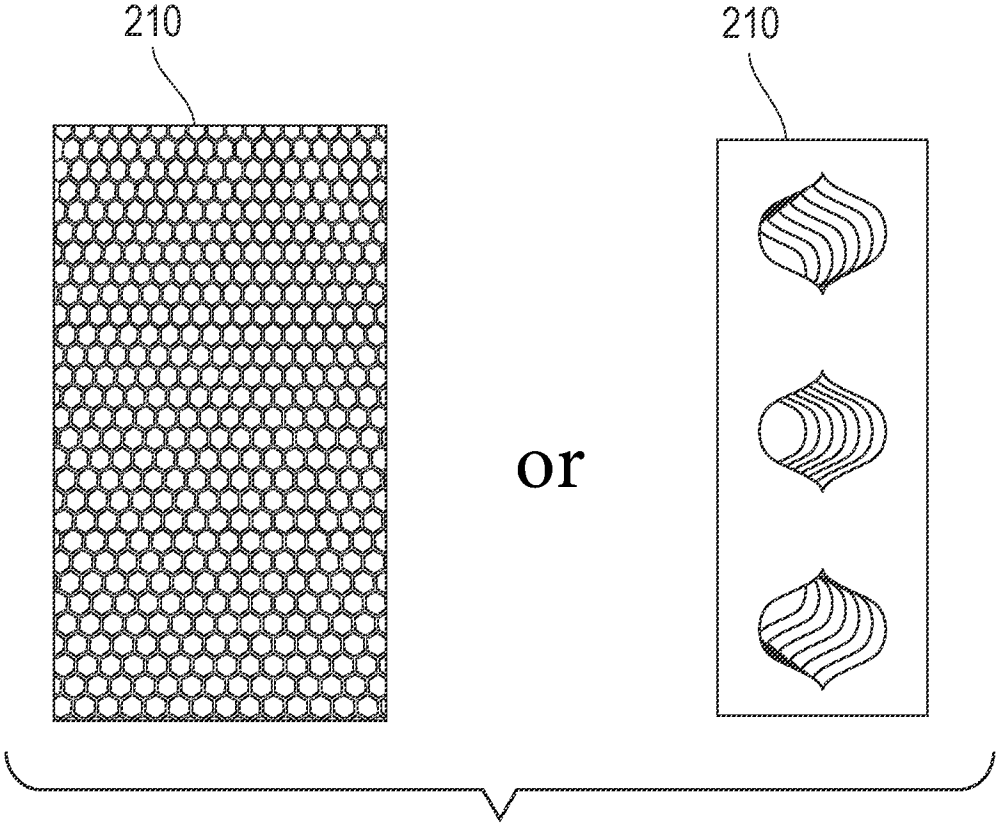
FIG. 14A illustrates an impact absorption layer according to a first embodiment.

In the illustrated embodiment, the impact absorption structure 200 is formed of two layers of material that offer the desired impact absorption properties. For purpose of illustration only, the figures show a solid block of impact absorption structure 200 and do not differentiate between the two layers that make up the structure 200. Exemplary materials to form the two layered structure 200 are shown in FIGS. 14A and 14B. For example, the impact absorption structure 200 is formed of a first layer 210 and a second layer 220. The first layer 210 is disposed against the inner surface of the outer protective shell 110, while the second layer 220 is disposed against the first layer 210. The footprints of the first layer 210 and the second layer 220 can be the same or they can be slightly different. Typically, the footprints of the first layer 210 and the second layer 220 will be at least substantially the same.

For example, the first impact absorption layer 210 can be formed of a thermoplastic honeycomb comprised of a co-extruded polycarbonate (PC) for energy absorption. This structure provides uniform mechanical properties due to its circular cell structure, and offers high compressive strength in a low-density material, decreasing transmitted force and peak g-force acceleration. The honeycomb is an efficient energy absorber, which is vital to impact protection, and is highly breathable. Depending on cell size and polymer density compression strength (DIN 53421), the material has been tested and such testing has resulted in durability against 101 to 522 psi (0.7 to 3.6 MPa), compression strength increases with smaller cell size. The intercellular connection is achieved without the use of glues of adhesives, but rather by thermal welding, which increases visual and performance consistency. Individual tubes are co-extruded with an inner and outer layer, each comprised of a different polymer; the outer layer has a lower melting point than the inner layer. The tubes are stacked in a mold, which is then heated and pressurized melting the exterior layer of each tube providing a thermo-weld between all adjacent tubes. The tubes are then cross cut into sheets. The welded honeycomb sheets can be further processed into finished dimensions and shaped parts with milling, thermoforming, cutting, profiling, lamination, plating, etc.

In one exemplary embodiment, the first impact absorption layer 210 can have a thickness of between about 3 mm to about 15 mm (e.g., 10 mm thick). The footprint of the first impact absorption layer 210 can be the same or similar to the footprint of the outer protective shell 110. Any number of means can be used to attach the first impact absorption layer 210 to the inner surface of the outer protective shell 110. For example, an adhesive or other bonding agent (e.g., pressure sensitive adhesives) or mechanical fasteners can be used to attach the first impact absorption layer 210 to the inner surface of the outer protective shell 110. Exemplary attachment means also include, RF welding, thermal bonding (e.g., heat activated epoxy film adhesive, etc.).

In another embodiment, the first impact absorption layer 210 can be an impact absorption material that can be provided in the form of a flexible plastic cushioning material layer that can provide a nearly linear force-deflection curve which allows for maximum comfort throughout the compression and shock cycle. The flexible plastic cushioning material layer can be formed of a plurality of molded flexible high polymer resin members comprising of inwardly directed indentations. The first layer 210 can have a thickness of about 13 mm. It will be understood that the first layer 210 can be formed to have other thicknesses; however, the first layer 210 will typically have a greater thickness than the second layer 220. The first layer 210 is shown in FIG. 14A.

The second layer 220 can be in the form of a protective padding product that can be in the form of a urethane foam material that is formed using breathable, anti-microbial, open or closed cell technology for the purpose of providing impact protection and comfort. The second layer 220 is shown in FIG. 14B. The second layer 220 can have a thickness of between about 2 mm and about 9 mm. It will be understood that the second layer 220 can be formed to have other thicknesses; however, the second layer 220 will typically have a greater thickness than the first layer 210. It will also be appreciated that the innermost layer of the impact absorbing material can have moisture wicking properties which are advantageous since the innermost layer contacts the hair and head of the user. For example, the innermost layer can be enclosed (encapsulated) within a moisture wicking anti-microbial fabric or the like or a thin layer of moisture wicking material can be applied to the inner surface of the innermost absorbing material.

As shown in the figures, the impact absorption structure 200 can cover most of the inner surface of the outer protective shell 110; however, the layer 200 can be eliminated from a portion of the right side portion 140 (for a right-handed pitcher). More specifically, the second section 145 of the right side portion 140 that covers and hangs below the ear can be free of the impact absorption structure 200. The outer protective shell 110 still covers these areas and thus offers protection. The absence of structure 200 allows sound to travel directly to the ear without significant attenuation from the surrounding structures.

FIGS. 1-8, 11 and 12 show the protective headgear 100 incorporating the two layer impact absorption structure 200 that is described herein; however, a single layer of absorption material can equally be used or a structure with more than two layers can also be equally used so long as these structures are capable of performing the intended function (i.e., absorption of applied forces).

Figure 13:
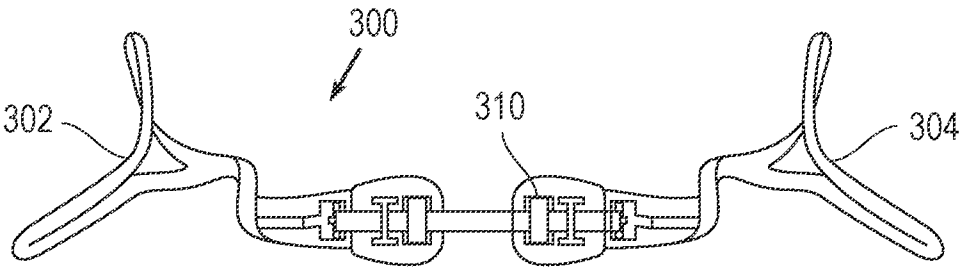
FIG. 13 is a rear view of one ratchet mechanism for tightening the headgear.

The protective headgear 100 includes a mechanism for adjusting the protective headgear 100 so that a secure fit is formed on the user's head. FIG. 13 shows one mechanism 300. The mechanism 300 is located at the rear of the protective headgear 100 and can be easily adjusted by the wearer of the protective headgear 100 so as to provide a secure, custom fit every time. By manipulating the mechanism 300, the left side portion 130 and the right side portion 140 can be drawn together so as to tighten the headgear 100 around the head of the wearer. Conversely, if the mechanism 300 is manipulated in an opposite manner, the left side portion 130 and the right side portion 140 are separated from one another, thereby loosening the headgear 100 around the head of the wearer. The mechanism can thus be operated by a single hand.

In the illustrated embodiment of FIG. 13, the mechanism 300 is in the form of an adjustable ratchet closure system which has a first end 302 that is attached to the left side portion 130 and a second end 304 that is attached to the right side portion 140. One or more actuators 310 of the mechanism 300 are configured to either drawn the ends 302, 304 toward one another or to cause separation between the ends 302, 304 and loosening of the protective headgear 100.

The present figures set forth different types of adjustment mechanisms that can be used including some that pull the side portions 130, 140 together using a ratcheting mechanism or the like. For example, FIGS. 1-8, 11 and 12 show an alternative mechanism 301 for adjusting the protective headgear 100 so that a secure fit is formed on the user's head. The mechanism 301 can be a ratchet based system or be another type and operates by having the wearer manipulate an actuator (e.g., a knob) to cause tightening or loosening of the mechanism 301 by pulling the sides 130, 140 together.

Figure 4:
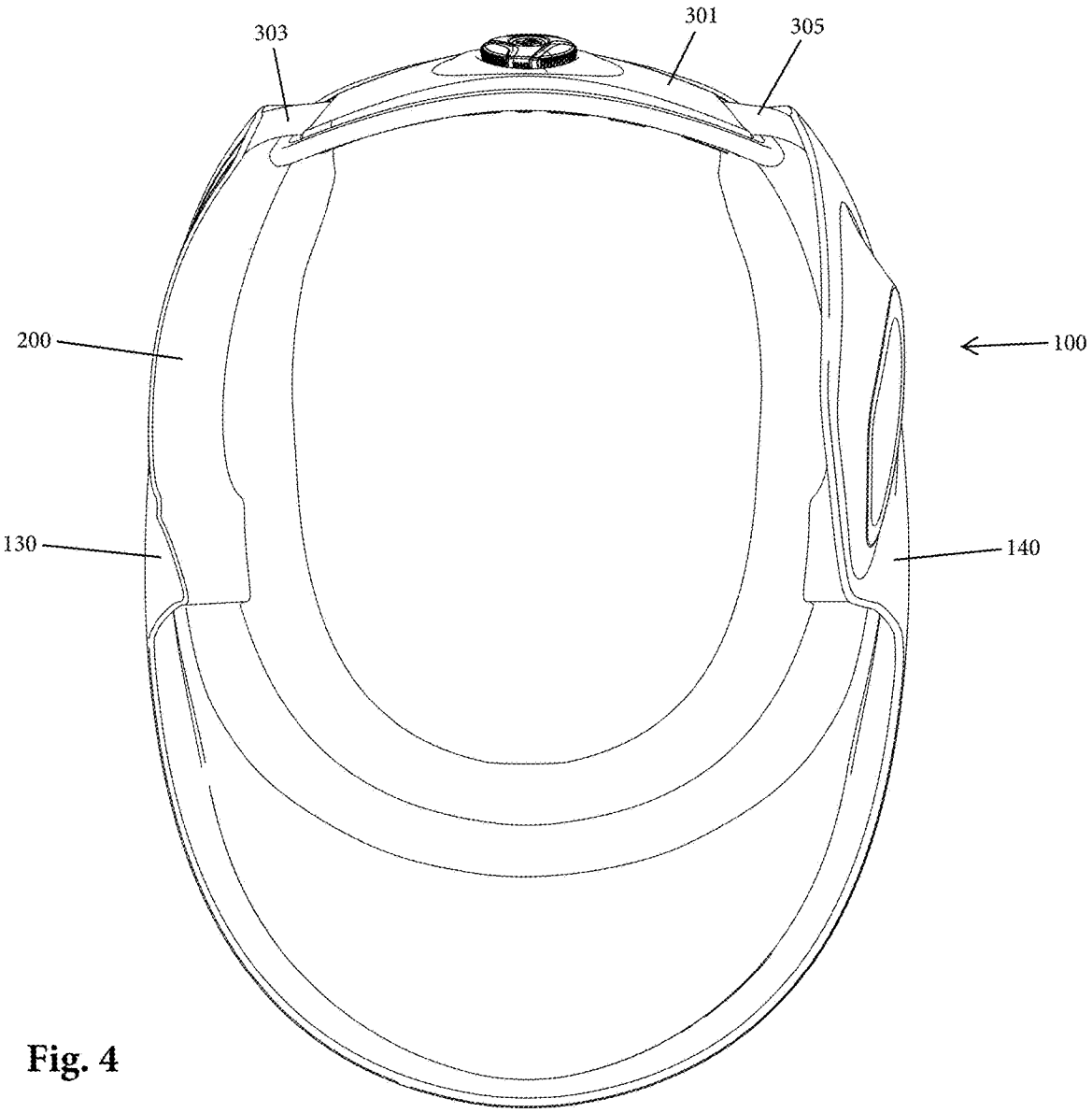
FIG. 4 is a bottom plan view of the protective headgear of FIG. 1.

As shown in FIG. 4, the mechanism 301 can be connected to the sides 130, 140 by elongated elastic bands 303, 305, respectively. These bands 303, 305 allows for movement of the mechanism 301 as the headgear is placed on or off the head and during wearing.

Alternatively, an elastic tension band (not shown) can be provided between the side portions 130, 140. In yet another embodiment, the mechanism 300 can be of interchangeable type in that the free ends of the side portions 130, 140 can include a connector or the like for releasably connecting to the mechanism 300 to allow the wearer the option to swap out one mechanism for another mechanism. For example, a ratchet mechanism with complementary connectors at its ends can mate with the connectors at the free ends of the side portions 130, 140 and similarly, an elastic tension band with connectors at its ends can be mated to the connectors at the free ends of the side portions 130, 140. This allows customization of the mechanism 300 that is used to tighten the headgear 100.

Additional adjustment mechanisms can also be used with headgear 100.

Figure 10:
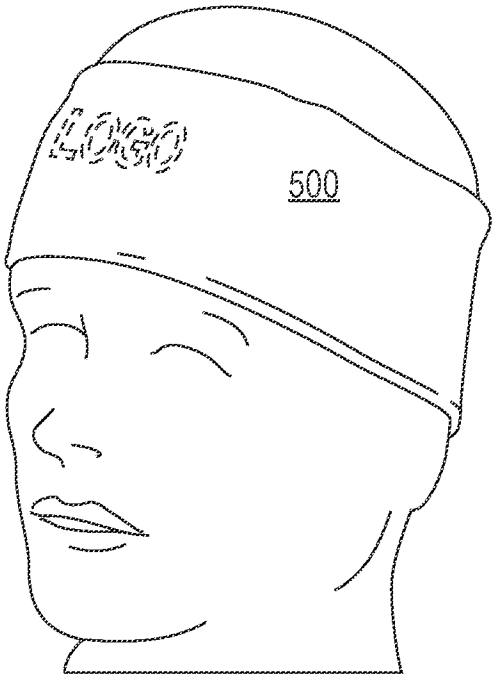
FIG. 10 is a front perspective view of an inner cap for use with the protective headgear.
Figure 11:
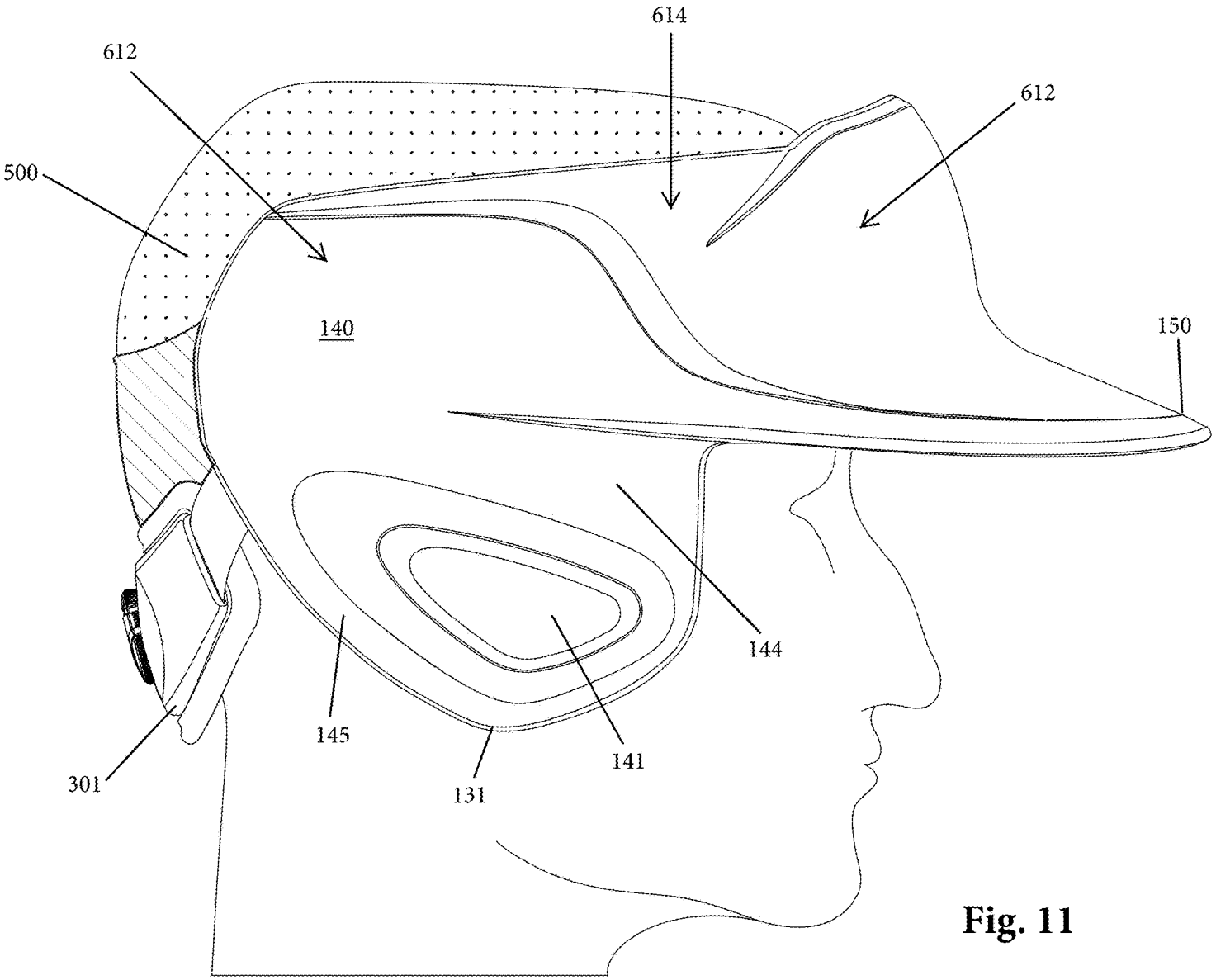
FIG. 11 is a right side elevation view of the protective headgear of FIG. 1 in use.
Figure 12:
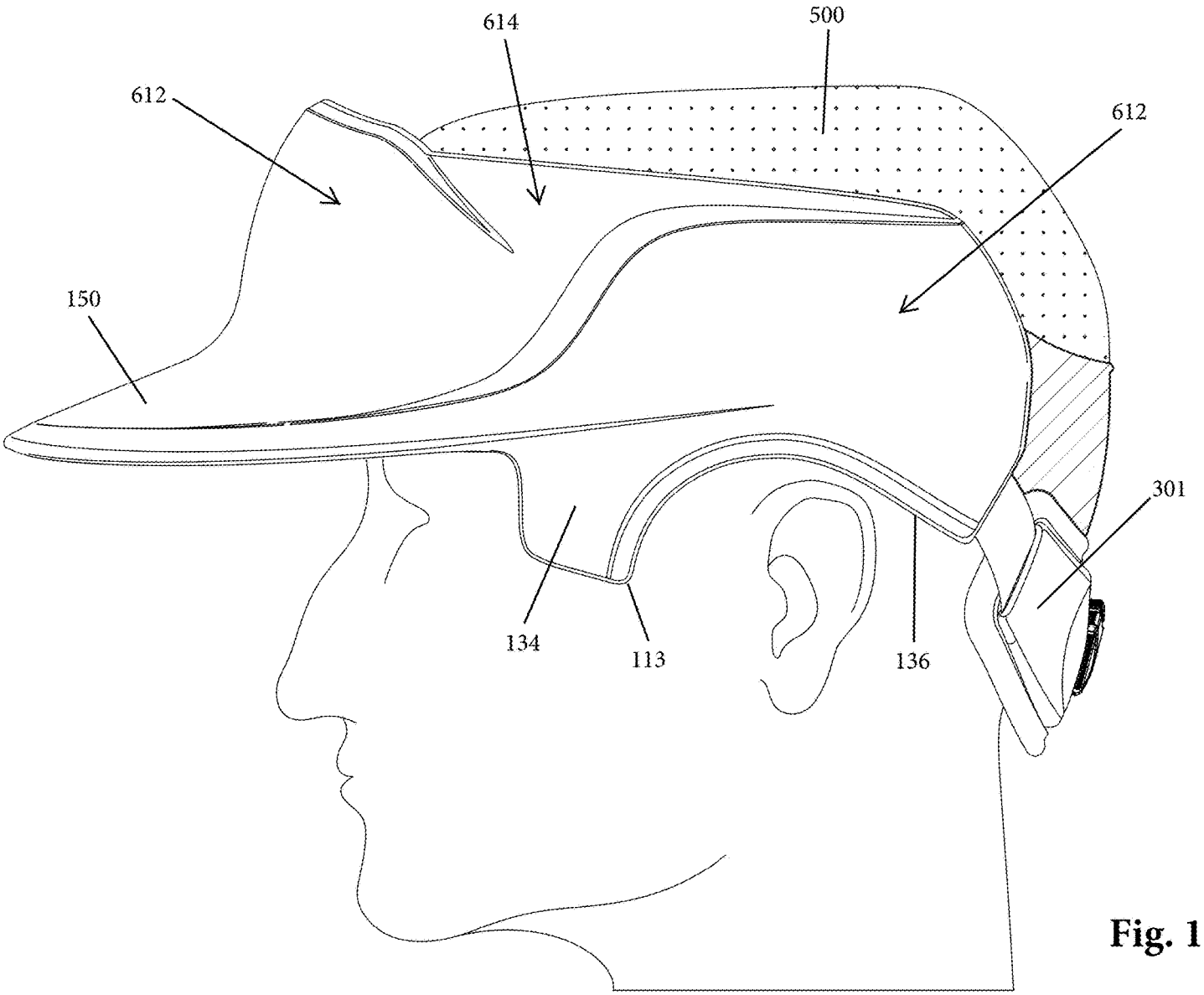
FIG. 12 is a left side elevation view of the protective headgear of FIG. 1 in use.

The protective headgear 100 is preferably intended to be worn with an inner cap 500 (FIG. 10). The inner cap 500 is formed of a breathable material and is configured not to interfere with the use of the protective headgear 100. For example, the inner cap 500 can be in the form of a skull cap formed of a breathable mesh. As is known, skull caps are stretchable so as to provide a tight fit when worn on the head. As a result, the protective headgear 100 can easily be worn over the skull cap 500. Since the protective headgear 100 is open along its top, the top of the skull cap 500 is visible when the cap and headgear 100 are combined. It will be appreciated that the skull cap 500 can be formed to have one color and the protective headgear 100 can be formed to have another color. Indicia, such as team logos, can be placed on one or both of the skull cap 500 and the protective shell 110.

Since the inner cap (skull cap) 500 is a separate part, it can be easily removed and cleaned or otherwise processed. This versatility also allows the appearance of the headgear to be slightly altered in that the color and/or indicia on the inner cap can be varied by simply switching the inner cap.

In one embodiment, the inner cap 500 and protective headgear 100 can be constructed such that the inner cap 500 is fixedly, yet releasably, attached (coupled) to the protective headgear 100. In particular, the inner cap 500 can be attached to either the protective shell 110 or even the impact absorption structure 200. Any number of different fastening techniques can be used to attach the inner cap 500 to the protective headgear 100. For example, one or more fasteners (e.g., snaps, hook and loop material, etc.) can be used to attach the inner cap 500 to the protective headgear 100. One half of the fastener pair is associated with the inner cap 500 and the other half of the fastener pair is associated with the headgear 100 (e.g., the protective shell 110 or the impact absorption structure 200.

In another embodiment, a bead can be formed along the periphery of the inner cap 500 and can be received within a corresponding groove formed in the protective headgear 100 (e.g., the groove can be formed in either the shell 110 or the impact absorption structure 200. To attach the inner cap 500 to the protective headgear 100, the bead is inserted into the groove. To release the inner cap 500, the bead is removed from the groove.

The attachment of the inner cap 500 is not permanent since it is directed to periodically remove the inner cap 500 for cleaning thereof.

It will also be appreciated that the headgear disclosed herein can be customized for a particular person using software that allows measurements to be taken of the user prior to manufacturing. For example, 3D head scanning technology can be used to ensure optimal player fit in that the shape and size of the various parts of the headgear can be made in view of this collected data (measurements).

Figure 7:
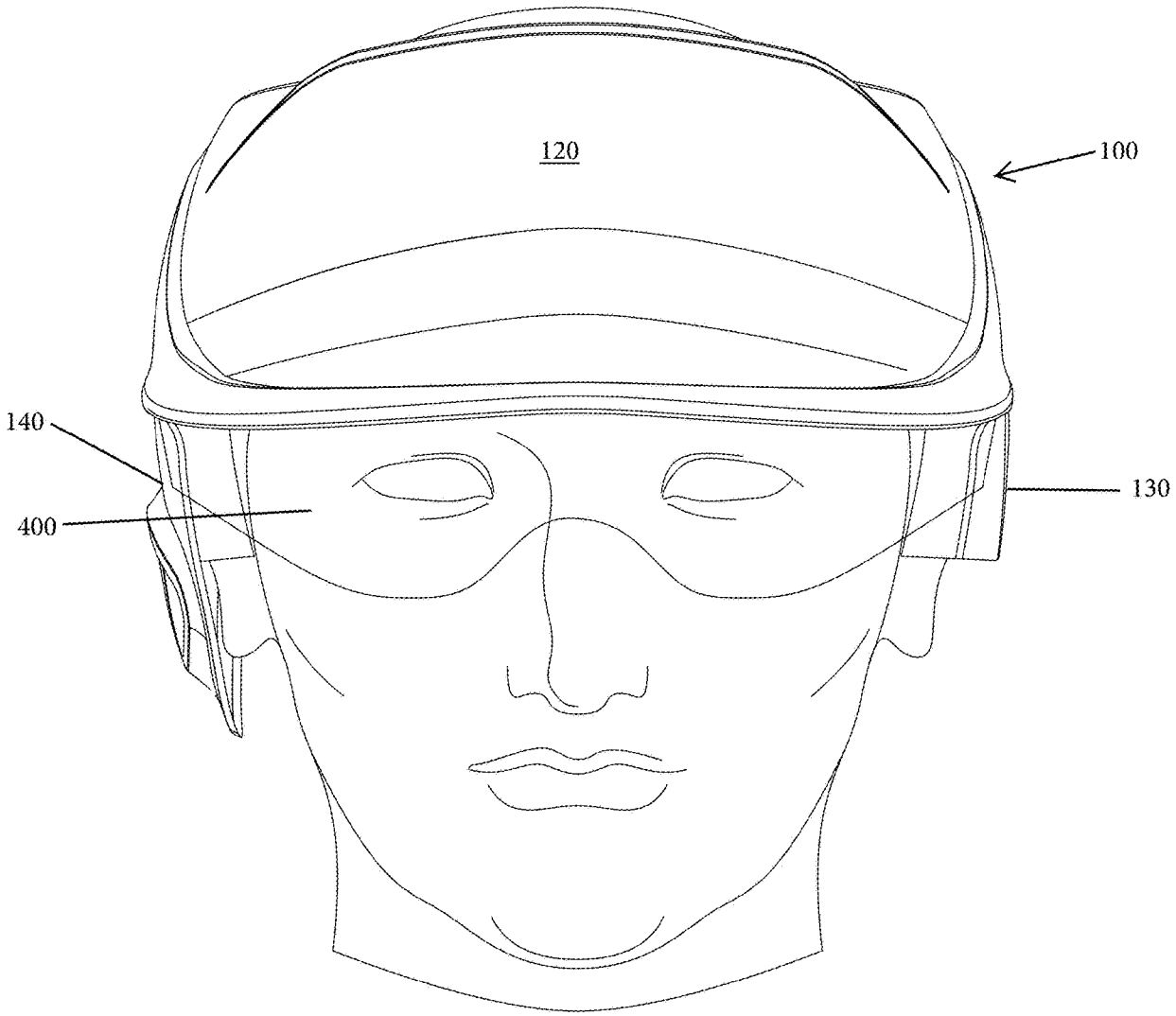
FIG. 7 is a front elevation view of the protective headgear of FIG. 1 with optional eye shield.
Figure 8:
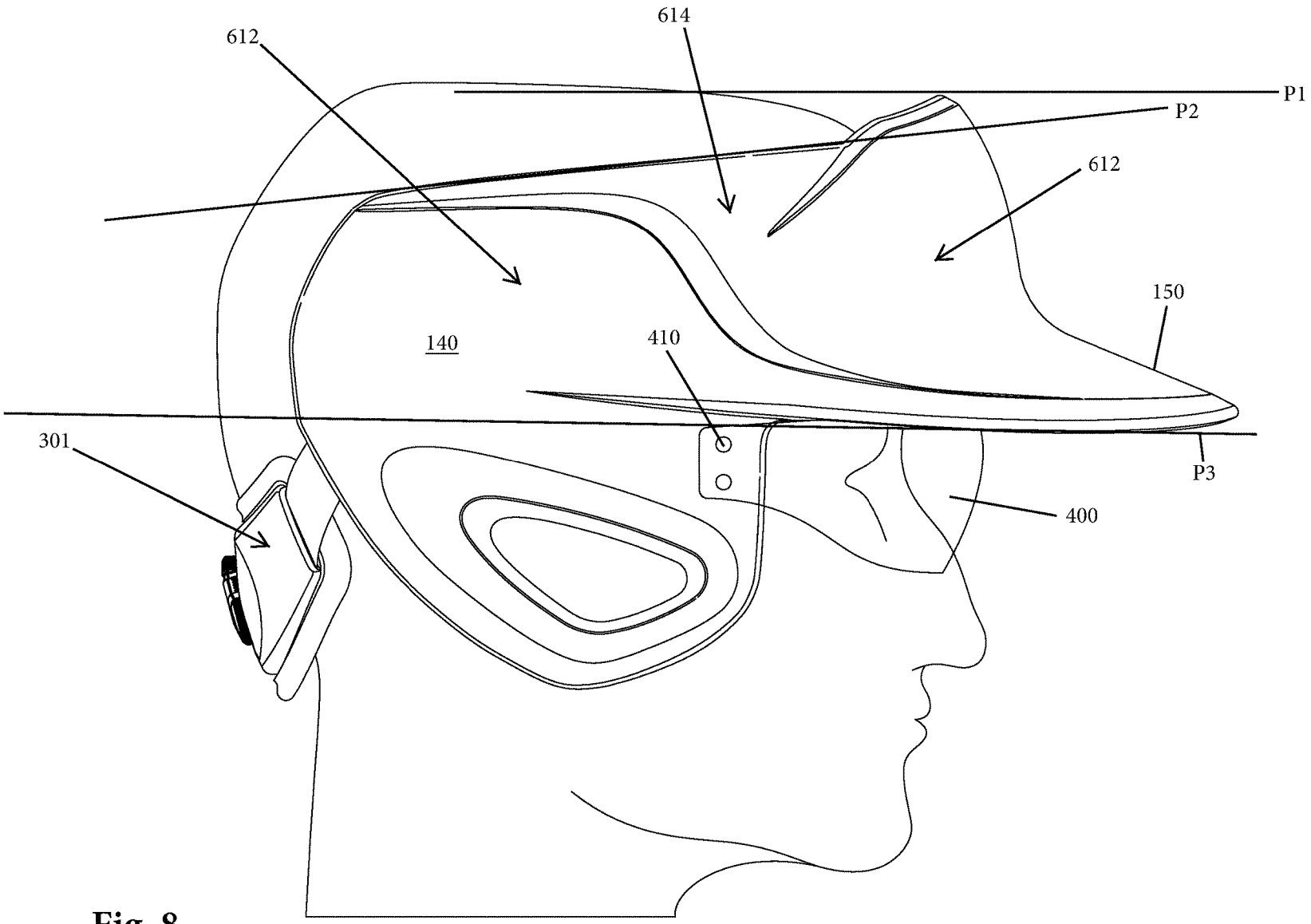
FIG. 8 is right side elevation view of the protective headgear of FIG. 1 with optional eye shield.
Figure 9:
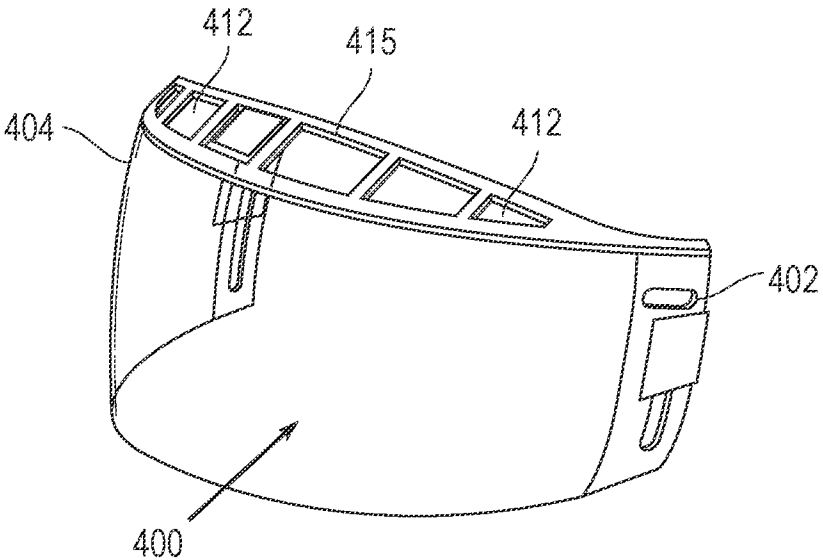
FIG. 9 is a front perspective view of an ocular shield for use with the protective headgear.

The protective headgear 100 can include a number of optional accessories. FIGS. 7-9 show an ocular shield 400. The ocular shield 400 can come in any number of different shapes and sizes. For example, the ocular shield 400 can come in a half shield format as shown in the aforementioned figures or can come in a full shield format (not shown) or other size. In the illustrated half shield format, the ocular shield 400 covers the eyes and the bottom edge extends across the nose. The ocular shield 400 is formed of a material that is suitable for use an optic element and thus, is formed of an optics grade material. For example, the ocular shield 400 can be formed of high strength polycarbonate and can have a thickness of between about 2 mm to about 3 mm in one embodiment.

The ocular shield 400 has an arcuate (curved) shape that terminates in a first end 402 and an opposite second end 404. The first end 402 is attached to the first (left) side portion 130, while the second end 404 is attached to the second (right) side portion 140. Any number of different techniques can be used to couple and securely attach the ends 402, 404 to the respective first and second side portions 130, 140. For example, the attachment can be of a detachable type or can be permanent in nature. To attach the ends 402, 404, fasteners 410 or the like can be used. In addition, a mechanical coupling can be used to attach the ocular shield 400 to the outer protective shell. For example, one of the outer protective shell 110 and the ocular shield 400 can include a protrusion and the other of the outer protective shell 110 and the ocular shield 400 can include a slot that receives the protrusion. The slot can include a locking portion into which the protrusion slides to thereby lock and attach the ocular shield 400 to the shell 110.

In addition, as shown in FIG. 9, the ocular shield 400 can also include a top lip or flange 415 that includes openings 412 that can mate with complementary features, such as locking protrusions, that are part of the protective shell 110, such as along the underside of the brim. This provides additional attachment points between the ocular shield 400 and the protective shell 110 beyond attachment to the side portions (temple portions) 130, 140 of the protective headgear 100.

In one embodiment, the protective headgear 100 includes an outer protective shell 110 and the impact absorption structure 200 which can be in the form of a multi-layer structure as described herein.

As mentioned previously, the outer protective shell 110 can have a variable wall thickness and more specifically, the shell construction is optimized to provide additional protection where the wearer is most vulnerable and is thinner in other less vulnerable regions to minimize weight. In particular, the areas of increased vulnerability are the forehead; the temple(s) region; and the side(s) of the head. In FIGS. 1-8, the regions of increased thickness, identified at 612, are noticeable and appear visually as slight bulges along the shell surface. The transition from one increased thickness region 612 to an adjacent area or region of reduced thickness, identified at 614, is marked by a sloped surface 615. The sloped surface 615 blends the two regions 612, 614 together in an aesthetically pleasing manner. The region of increased thickness 612 can be located on both sides of the outer protective shell 110 or can be located only on the side that includes the ear protection and marks the side that faces the direction at which the ball is thrown (e.g., the pitcher's mound).

By varying the thickness of the outer protective shell 110 in a localized manner, the shell 110 provides increased protection in the vulnerable regions, while the less vulnerable areas have reduced thickness, which provides an overall weight reduction in the protective headgear 600.

The outer protective shell 110 can be formed of the same materials as the outer protective shell 110 and therefore, can be formed of a composite material as discussed herein. As shown in FIG. 8, the top edge of the outer protective shell 110 lies in at least two different planes with the top edge of the curved front portion lying in a first plane (P1) above a second plane (P2) that contains at least a first portion of the first top edge of the first side wing and at least a second portion of the second top edge of the second side wing. The second plane (P2) intersects the first plane (P1) and passes through the curved front portion above the brim. Each of the first top edge of the first side wing, including the first portion thereof, and the second top edge of the second side wing, including the second portion thereof, extends in a direction from the respective first and second rear edges towards the brim which lies in a third plane (P3) that intersects the first and second rear edges of the first and second side wings.

As discussed herein, the impact absorption structure 200 can be formed of the first layer 210 and the second layer 220. The first layer 210 is adjacent the outer protective shell 110, while the second layer 220 is disposed against the first layer 210 and is in contact with the head of the wearer.

As mentioned herein, the first layer 210 can be in the form of a copolymer honeycomb matrix impact absorption layer. The lightweight copolymer honeycomb matrix acts as a "crumple zone," providing the second layer of impact absorption defense.

The second layer 220 can be in the form of a non-Newtonian foam liner. Any number of different non-Newtonian foam materials can be used so long as they are suitable for the intended application described herein. Suitable materials for the second layer 220 are described herein and include urethane foams.

The second layer 220 can be in the form of a single layer or the second layer 220 can itself be comprised of multiple layers (e.g., a laminate formed of multiple foam layers. More specifically, the second layer 220 can be a multi-layer non-Newtonian foam liner. For example, the second layer 220 can be formed of two or more discrete layers of non-Newtonian foam with each layer having different material characteristics. In one exemplary embodiment, the second layer 220 comprises three discrete foam layers that are bonded to one another and have varying densities. In particular, the densities of the three layers progressively increase in a direction from the inside of the helmet toward the outside. In other words, the density of the innermost foam layer that contact the wear's head has the lowest density, while the outermost foam layer that is in contact with the first layer 210 has the highest density (and the intermediate foam layer has a density between these two densities).

The multilayer foam liner (second layer 220) utilizes varying densities, which have been optimized for fit and comfort. The contouring non-Newtonian foam instantly dissipates force upon impact to disperse the energy, especially for high-speed impacts.

In one embodiment, the multilayer foam liner comprises a three layer foam (e.g., urethane foam) laminate. In other words, the three layer foam can be formed of the same material, such as urethane. A selected first foam layer has a first thickness and a first density and is laminated to a second foam layer that has a second thickness and a second density. The first and second thicknesses can be the same or can be different and in one example, each of the first and second thicknesses can be about 3 mm and the first density is greater than the second density. A selected third foam layer has a third thickness and a third density and is laminated to the second foam layer. Prior to lamination, the third foam layer can be skived so as to impart a pattern on one side of the foam layer and the skiving step results in the third foam layer having a variable thickness. For example, the third foam layer can have a thickness that is less than the first and second thicknesses (e.g., a variable thickness from 0.5 mm to about 2.5 mm). This third foam layer preferably has a different density than the other layers so as to act as a comfort foam due to its positioning next to and in contact with the wearer's head.

As will be appreciated from the foregoing discussion, the outer protective shell 100 helps to spread the energy (from an applied force) across the whole of the head, while the impact absorption structure 200 acts as both a crumple zone and compresses (foam) and absorbs the impact energy. Further, the multi-layer foam laminate adds to impact protection by slowing down the speed of the impacted object at different rates of times due to the different density foams.

While the protective headgear is described herein as being for use in the sport of baseball, the headgear can be in the sport of softball and also can equally be used in other sports in which head protection is desired.

The protective headgear described herein not only provides the desired protection but also provides a number of other advantages. More specifically, the protective headgear 100 is based on a proven cap form factor and is designed to provide good ventilation and a secure fit. The protective headgear is configurable with options to protect vulnerable temples and the face of the wearer. The various constructions described and illustrated herein, provide temple protection on both sides and frontal protection with the rigid brim. In one embodiment, full ear protection is provided for the pitching side. Facial protection is provided with the optional ocular shield.

As discussed herein, many of the features and the actual construction of the headgear can be customized for a particular user. For example, 3D anatomical scanning can be performed, the temple and ear protection described herein can be customized and there also customization options for the eye, nose, and full face protection. Thus, the construction of the headgear can be part of a computer implemented process in which certain anatomical data is first collected by a computer system and then software, such as a 3D modeling program, can be used to create a graphic representation of the user's head. From this graphic representation, the various components of the present headgear can be modeled and then formed so as to provide the user with a custom fit headgear.

In one exemplary embodiment, the protective headgear 600 has the following specifications:

Thickness: ~0.7"

Weight: Between about 10 and 12 ounces based on head size.

Protection: Laboratory testing shows that the Half Cap passes the National Operating Committee on Standards for Athletic Equipment (NOCSAE) standard at a minimum of 85 mph.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A protective headgear for a baseball or softball player, the protective headgear comprising:

a rigid outer protective shell that is generally U-shaped and defined by a brim, a first side wing that extends rearwardly and terminates in a first rear edge and includes a first top edge that is separately distinct from the first rear edge and intersects a top of the first rear edge, and an opposing second side wing that extends rearwardly and terminates in a second rear edge and includes a second top edge that is separately distinct from the second rear edge and intersects a top of the second rear edge, wherein the brim, the first side wing and second side wing are formed as a single unitary structure, wherein the rigid outer protective shell has a variable wall thickness and is open along a top portion and a rear portion of the outer protective shell between the first and second side wings, the rigid outer protective shell including a curved front portion that is formed above the brim and defines at least in part a top edge of the rigid outer protective shell, wherein a front edge of the brim defines a front end of the outer protective shell, the top edge of the outer protective shell lying in at least two different planes with the top edge of the curved front portion lying in a first plane above a second plane that contains at least a first portion of the first top edge of the first side wing and at least a second portion of the second top edge of the second side wing, wherein the second plane intersects the first plane and passes through the curved front portion at a location above the brim, wherein each of the first top edge of the first side wing, and the second top edge of the second side wing, extends in a direction from the respective first and second rear edges towards the brim which lies in a third plane that intersects the first and second rear edges of the first and second side wings, wherein the first side wing has an ear portion formed along a bottom edge of the first side wing for covering an ear of the player, the first top edge extending above the ear portion and further extending forward of the ear portion towards the brim and rearward of the ear portion towards the first rear edge;

an impact absorption material disposed along an inner surface of the rigid outer protective shell including along the curved front portion; and a mechanism for adjusting a size of the rigid outer protective shell;

wherein the impact absorption material comprises:

a copolymer honeycomb matrix impact absorption layer that is formed of two different polymers including a co-extruded polycarbonate material, wherein the copolymer honeycomb matrix impact absorption layer is coupled along a first surface to the inner surface of the outer protective shell, and a non-Newtonian foam layer that is coupled to, and has a first surface in direct contact with, a second surface of the copolymer honeycomb matrix impact absorption layer.

2. The protective headgear of claim 1, wherein the copolymer honeycomb matrix impact absorption layer has a compressive strength of between 0.7 and 3.6 MPa according to DIN 53421.

3. The protective headgear of claim 1, wherein each of the first side wing and the second side wing has a top portion of a first thickness and a bottom portion of a second thickness that is greater than the first thickness and wherein a transition between the top portion and the bottom portion for each of the first side wing and the second side wing is defined by a sloped surface.

4. A protective headgear for a baseball or softball player, the protective headgear comprising:

a rigid outer protective shell; and an impact absorption structure disposed along an inner surface of the rigid outer protective shell, wherein the impact absorption structure comprises:

a copolymer honeycomb matrix impact absorption layer coupled along a first surface to the inner surface of the rigid outer protective shell, and a non-Newtonian foam layer that is coupled to, and in direct contact with, a second surface of the copolymer honeycomb matrix impact absorption layer;

wherein the non-Newtonian foam layer comprises two or more discrete foam layers that are formed of the same foam material, each foam layer of the two or more discrete foam layers having a different density than the one or more other foam layers;

wherein the rigid outer protective shell has a front portion, a first side portion, a second side portion, a top opening, and a rear opening, the front portion including a brim extending in a forward direction to define a front edge of the outer protective shell, wherein the rear opening is defined between a first free end of the first side portion and a second free end of the second side portion, the rigid outer protective shell being an integral structure formed of a single composite material and having a variable wall thickness, such that the front portion, a lower region of the first side portion, and a lower region of the second side portion have increased thickness relative to a thickness of an upper region of the first side portion and a thickness of an upper region of the second side portion, the upper region of the first side portion including a top edge of the first side portion and the upper region of the second side portion including a top edge of the second side portion, wherein both the upper region and the lower region of the first side portion extend to the first free end and both the upper region and the lower region of the second side portion extend to the second free end; and wherein a topmost edge of the rigid outer protective shell is defined by a top edge of the front portion, the top edge of the first side portion, and the top edge of the second side portion, the top edge of the first side portion and the top edge of the second side portion both being smooth linear edges.

5. The protective headgear of claim 4, wherein the copolymer honeycomb matrix impact absorption layer has a compressive strength of between 0.7 and 3.6 MPa according to DIN 53421.

6. The protective headgear of claim 4, wherein the rigid outer protective shell has asymmetric temple guards formed as part of the first and second side portions of the rigid outer protective shell, respectively.

7. The protective headgear of claim 6, wherein the first side portion includes an enhanced temple guard that has a bottom edge for placement below an ear of the player and is configured to cover at least a majority of the ear of the player.

8. The protective headgear of claim 7, wherein the enhanced temple guard includes an opening for placement over the ear of the player.

9. The protective headgear of claim 7, wherein the impact absorption structure is disposed on the enhanced temple guard and is configured to not extend below the ear of the player.

10. The protective headgear of claim 4, wherein the rigid outer protective shell is generally U-shaped with the first and second side portions defining legs of the U-shape.

11. The protective headgear of claim 4, further comprising a closure mechanism for selectively closing and opening the first and second side portions of the rigid outer protective shell relative to one another using a single hand.

12. The protective headgear of claim 11, wherein the closure mechanism comprises a ratchet mechanism that is operable to draw the first and second side portions either towards or away from one another.

13. The protective headgear of claim 12, wherein the closure mechanism extends across the rear opening between the first and second side portions.

14. The protective headgear of claim 4, further comprising an ocular shield that is attached at a first end to the first side portion of the rigid outer protective shell and at an opposite second end to the second side portion of the rigid outer protective shell.

15. The protective headgear of claim 14, wherein the ocular shield is detachably connected to the rigid outer protective shell.

16. The protective headgear of claim 4, wherein the rigid outer protective shell comprises a carbon fiber/aramid composite.

17. The protective headgear of claim 4, further including an inner cap to be worn beneath the rigid outer protective shell, the inner cap being formed of a breathable material, wherein the inner cap is a stretchable skull cap formed of mesh material.

18. The protective headgear of claim 4, wherein the copolymer honeycomb matrix impact absorption layer has a thickness of between 4 mm and 15 mm and the non-Newtonian foam layer has a thickness of between 2 mm and 6 mm and the rigid outer protective shell has a thickness between 1 mm and about 5 mm.

19. The protective headgear of claim 4, wherein the non-Newtonian foam layer comprises three polyurethane foam layers, each polyurethane foam layer of the three polyurethane foam layers having a different density than the other polyurethane foam layers, wherein the densities of the three polyurethane foam layers progressively increase in a direction towards the outer protective shell.

20. The protective headgear of claim 4, wherein a transition between the front portion and each of the upper regions of the first and second side portions is defined by a sloped surface, a transition between the lower region of the first side portion and the upper region of the first side portion is defined by a sloped surface and a transition between the lower region of the second side portion and the upper region of the second side portion is defined by a sloped surface.

* * * * *